United States Patent [19]

Waldrum

[11] 4,454,988

[45] Jun. 19, 1984

[54] SELF-CLEANING NOZZLE

[75] Inventor: John E. Waldrum, Ambler, Pa.

[73] Assignee: Union Carbide Corporation, Danbury, Conn.

[21] Appl. No.: 361,190

[22] Filed: Mar. 24, 1982

[51] Int. Cl.[3] ..... B05B 15/02

[52] U.S. Cl. ..... 239/118

[58] Field of Search ..... 239/114–118, 239/171; 222/149; 244/136

[56] References Cited

U.S. PATENT DOCUMENTS

| | | | |
|---|---|---|---|
| 1,236,617 | 8/1917 | Speakman | 239/118 |
| 1,953,990 | 4/1934 | Roselund | 239/117 |
| 3,204,873 | 9/1965 | Senninger | 239/118 |
| 3,445,065 | 5/1969 | Waldrun | 239/171 |
| 3,523,646 | 8/1970 | Waldrun | 239/171 |
| 4,231,520 | 11/1980 | Waldrun | 239/171 |
| 4,283,012 | 8/1981 | Hanson | 239/118 |
| 4,384,674 | 5/1983 | Somerville | 239/118 |

FOREIGN PATENT DOCUMENTS

| | | | |
|---|---|---|---|
| 56650 | 9/1939 | Denmark | 239/118 |

*Primary Examiner*—Andres Kashnikow

*Attorney, Agent, or Firm*—Clement J. Vicari

[57] ABSTRACT

A self-cleaning nozzle for use in spray devices. Liquid is discharged under pressure through a plurality of capillary tubes. After use, the capillary tubes are automatically cleaned by cleaning elements which are urged through the capillary tubes.

4 Claims, 3 Drawing Figures

SELF-CLEANING NOZZLE

DESCRIPTION

1. Technical Field

The present invention relates to a spray nozzle for use with apparatus for spraying fluids, e.g., liquids such as herbicides and pesticides from a moving vehicle. More particularly, the present invention relates to a self-cleaning nozzle which can be used in apparatus for spraying liquids from a moving aircraft.

2. Background Art

The problem of drift during the spraying of herbicides and pesticides is well known and is discussed in my U.S. Pat. Nos. 3,445,065, 3,523,646 and 4,231,520. The term "drift" refers to the displacement of a portion of the spray from its intended spray pattern into undesired areas. Drift is generally caused by unpredictable winds, drafts, air turbulence, etc. Minimization of drift is a major objective in spraying operations. The powerful properties of a systemic herbicide are sufficient to kill a plant. While systemic herbicides are selective, such herbicides will attack certain economic crops, therefore, they must be applied in a carefully controlled manner. Likewise, untoward results can ensue if systemic insecticides drift into areas where it is not intended to apply them.

As discussed in the previously mentioned U.S. patents, the problem of drift is particularly acute when fine droplets are present in the spray. Generally, droplets of less than about 300 microns in diameter are considered to be undesirable from the point of view of being subject to drift. To control drift it is considered highly desirable to have spray devices which produce droplets of substantially uniform size.

The problem of drift can be minimized by discharging the liquid in a laminar stream from a spray nozzle while the nozzle is moving in a direction substantially opposite the direction of spray discharge. By discharing the stream in a direction opposite the direction of movement of the nozzle the formation of small "satellite" droplets is prevented. These satellite droplets which are formed when liquid is discharged in a laminar flow from a stationary nozzle tend to be subject to drift in cross winds and turbulent conditions. These concepts are explained in greater detail in U.S. Pat. Nos. 3,445,065; 3,523,646 and 4,231,520.

In order to utilize the concepts taught in these patents, capillary tubes are required to produce the desired small droplet sizes. Unfortunately, however, the capillary tubes are easily clogged during and after operation either by contaminants or by liquids which contain suspended solids.

Thus, it is an object of the present invention to provide a self-cleaning spray nozzle for a spray device which will spray liquids, such as herbicides and insecticides, in droplets of essentially uniform size from a moving vehicle, such as a helicopter or airplane, so as to minimize the problem of drift.

It is another object of the invention to provide such a spray nozzle device which is constructed in such a way that it can be automatically self-cleaned after use.

Other objects and advantages of the present invention will be apparent to the skilled worked in the art from the description that follows.

DISCLOSURE OF INVENTION

Broadly contemplated, the present invention provides a self-cleaning nozzle for use in spray devices comprising a hollow body, liquid supply means for supplying liquid under pressure to said hollow body; liquid discharge means associated with said hollow body for discharging pressurized liquid from said hollow body, said liquid discharge means including capillary tubes for discharging pressurized liquid from said hollow body; and capillary blocking and cleaning means disposed and positioned in said hollow body and adapted to be urged toward a first position during which said cleaning and capillary blocking means clean said capillary tubes and block the passage of liquid through said capillary tubes and which are adapted to be urged toward a second position in which said cleaning and blocking means are partially withdrawn from said capillary tubes whereby said pressurized liquid in said hollow body is permitted to flow through said capillary tubes.

In a more specific aspect of the invention, the capillary tubes are contained in a plurality of closely packed discharge pipes projecting outwardly from the hollow body, each discharge pipe accommodating a plurality of capillary tubes and each of the capillary tubes having a capillary tube port in liquid communication with the liquid in the hollow body.

The cleaning and capillary blocking means include urging means, a piston which is movable in the hollow body, and cleaning elements associated with the piston. Each of the cleaning elements are positioned in axial alignment with a corresponding capillary tube and are adapted to traverse a path through a corresponding capillary tube. The urging means are capable of urging the piston toward the capillary tubes and the cleaning elements through the capillary tubes to a first position in which the cleaning elements block the tube ports when the liquid pressure is below a predetermined actuating pressure in the hollow body. The urging means also permit the piston and the cleaning elements to be forced in a direction opposite from the capillary tubes to a second position in which the cleaning elements are in non-blocking relation with the tube ports of the capillary tubes when the liquid pressure in the hollow body is above a predetermined activating pressure so that liquid will flow through the capillary tubes.

An optional feature of the present invention is a manual override shaft which provides an external means to dislodge the piston if movement becomes restricted. The manual override shaft also gives a visual representation of the piston stroke.

BRIEF DESCRIPTION OF THE DRAWINGS

Referring, now in greater detail to the various figures of the drawings, in which like reference characters refer to like parts, there is shown in FIG. 1, an exploded perspective view of the self-cleaning nozzle 10 of the present invention. The nozzle includes a hollow body 12 formed by the threaded mating engagement of cylinder 14 with central body 16. The hollow body 12 receives pressurized liquid through liquid inlet 18 from a liquid supply source (not shown). Positioned at one end of hollow body 12 are liquid discharge means which are shown in the drawing as a plurality of liquid discharge pipes 20 emanating outwardly from hollow body 12. As shown in FIG. 2 one end of each discharge pipe 20 is connected to one of the liquid outlet ports 22 by any suitable means such as by threads disposed on one end of the discharge tube 20, which are threaded into mating threads in outlet ports 22. Each other end of the discharge pipes 20 project in a direction essentially opposite the direction of movement of the vehicle to which the spray device utilizing the self-cleaning nozzle is affixed during use.

Figure 1:
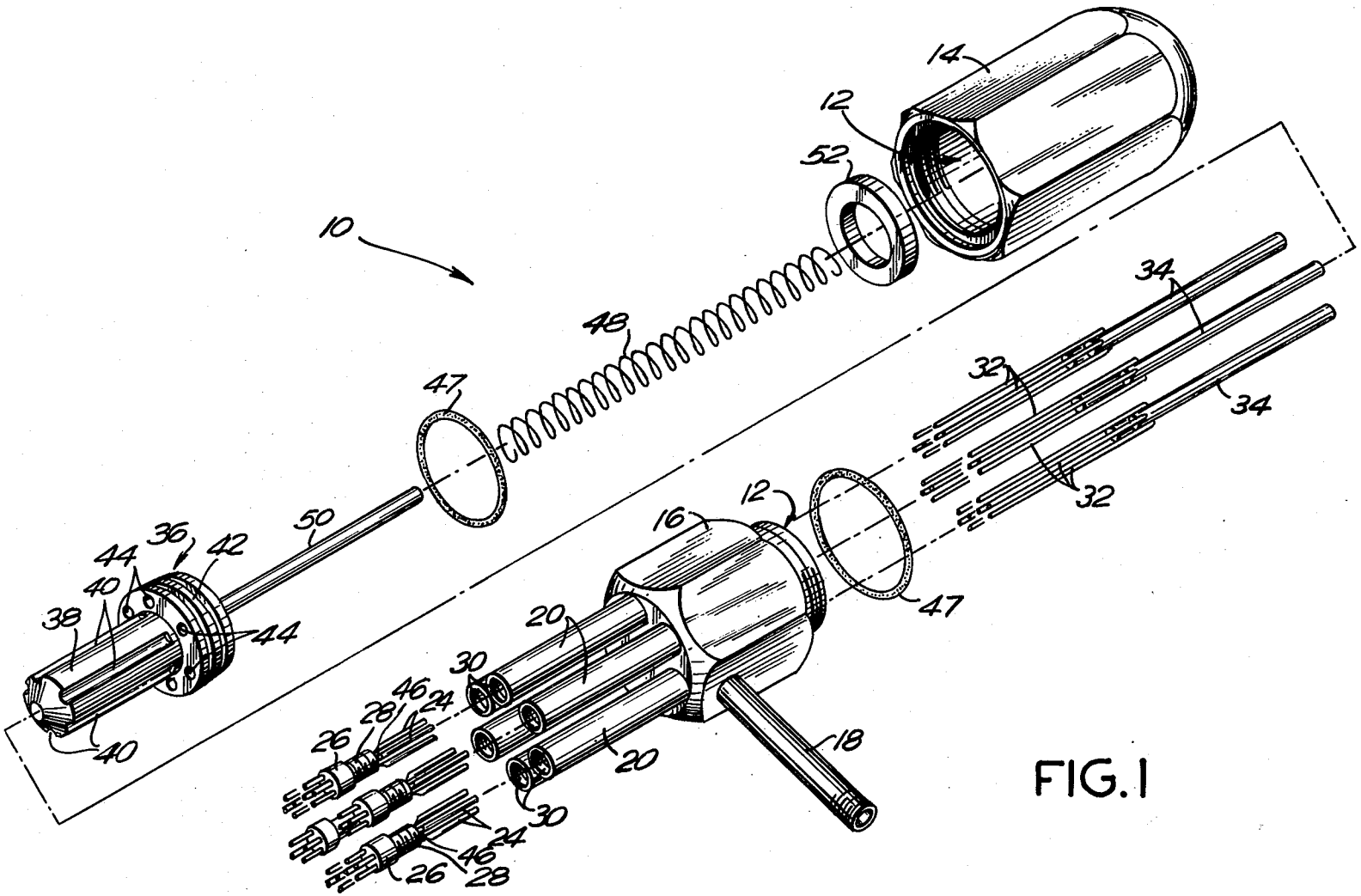
FIG. 1 is an exploded perspective view of the self-cleaning nozzle.

Referring again to FIG. 1, it will be seen that the liquid discharge means include capillary tubes 24, which extend through tube body 26. Tube body 26 is threadably mounted to discharge pipes 20 by threads 28 disposed on one end of the tube body which are threaded into mating threads 30, disposed in the end of discharge pipe 20 projecting away from hollow body 12.

As will be seen from FIG. 1, the capillary tubes 24 extend through tube body 26 proximate the outer periphery of each tube body.

The self-cleaning nozzle also includes capillary blocking and cleaning means which are adapted to block the flow of liquid through capillary tubes 24 and to clean or purge the interior of the capillary tubes at the cessation of spraying. Thus, the capillary blocking and cleaning means include cleaning elements such as cleaning needles 32 which are affixed to one end of needle drive shaft 34 as shown in FIG. 1. The cleaning needles are slightly less in diameter than the inner diameter of the tubes so that they can be directed through the tubes in minimal contact with the inner wall of the tubes.

Disposed within central body 16 and cylinder 14, is piston 36 which is in effect a moveable pressure activated plunger which reciprocates in the central body 16 and cylinder 14 and has an elongated portion 38. The elongated portion 38 has a hollow interior and is provided with a plurality of grooves 40 on its exterior which accommodate needle drive shafts 34. The piston is preferably cylindrical in configuration and is also provided with a flange portion 42 having stop holes 44 which receive the other end of needle drive shafts 34, i.e., the ends nearest the central body 16. Each of the cleaning needles 32 are positioned on the needle drive shafts 34 so that each needle is in axial alignment with a corresponding capillary tube 24 when the assembly depicted in FIG. 1 is secured together.

Each of the capillary tubes 24 are provided with tube ports 46 which are positioned proximate tube body 26 so that they can admit liquid from discharge pipes 20 the latter providing a continuous conduit between capillary tubes 24 and central body 16.

Returning again to FIG. 1, it will be seen that the device is sealed by O-rings 47 between the central body 16, cylinder 14 and piston 36 to prevent leakage of liquid. In addition spacer ring 52 disposed within cylinder 14 limits the stroke of piston 36 during movement of the piston under the influence of liquid pressure. Finally, cylinder 14 can be provided with an atmospheric vent port (not shown) which facilitates piston travel.

Figure 2:
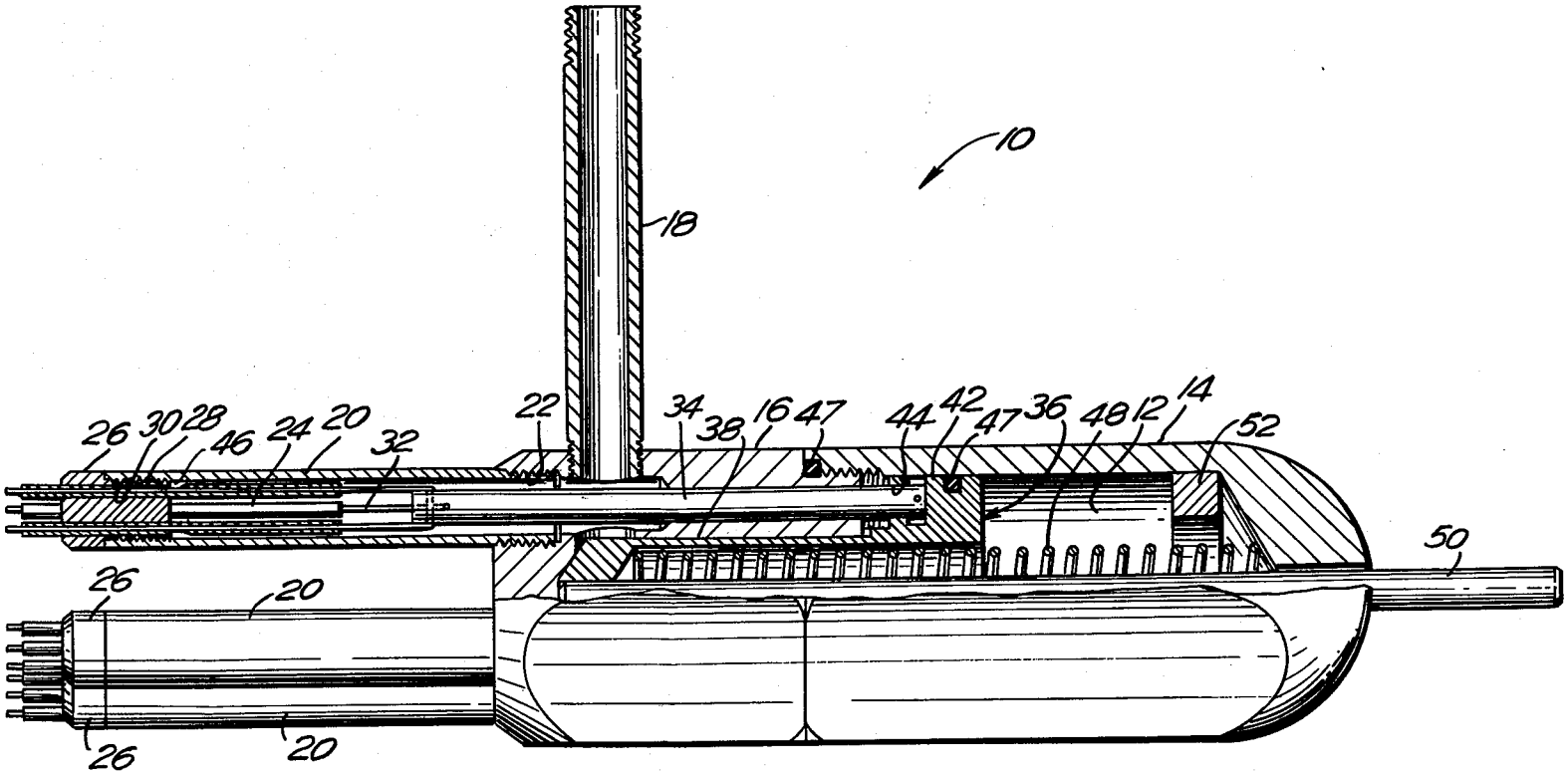
FIG. 2 is a side elevation partly in section showing the device in the first position wherein the cleaning elements extend through the capillary tubes and block the tube ports.

In a non-operating position, the device is as shown in FIG. 2 wherein the piston 36 is urged towards the discharge means with cleaning needles 32 being urged through capillary tubes 24 to a first position in which the cleaning needles block the tube ports 46. This is accomplished by the action of spiral spring 48 positioned around manual overide shaft 50 which directs a force against the rear inner surface of elongated portion 38 of piston 36 when the device is in the position shown in FIG. 2.

Figure 3:
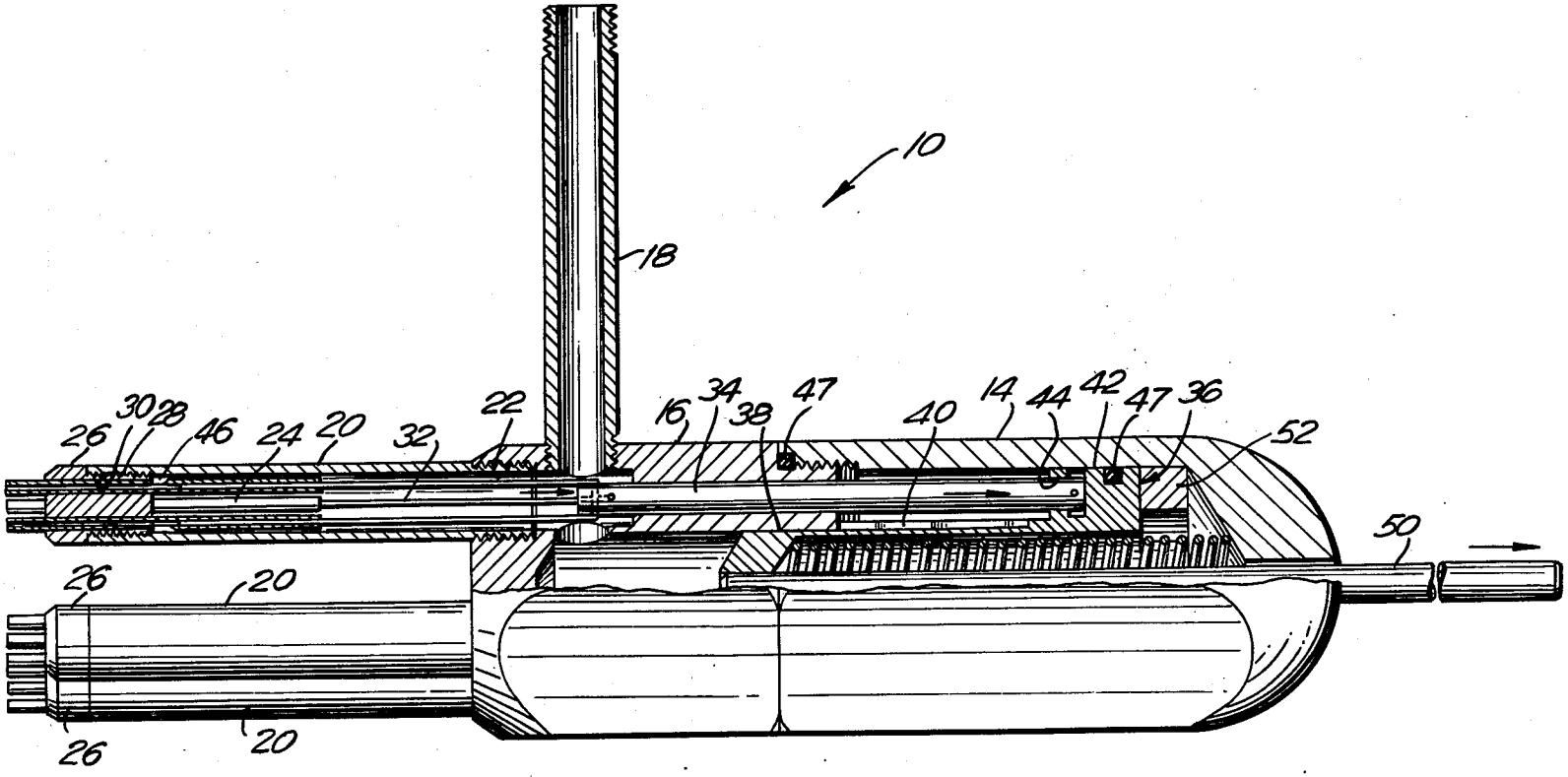
FIG. 3 is a side elevation partly in section showing the device in the second position wherein the cleaning elements are partially retracted along the capillary tubes exposing the tube ports for entry of the pressurized liquid.

In a typical mode of operation, and commencing with the device in the closed position as shown in FIG. 2, the central body 16 is pressurized by liquid passing through liquid inlet 18 from a supply source (not shown). The pressure in the central body 16 gradually increases and moves piston 36 through the cavity of central body 16 into cylinder 14 resulting in compression of spiral spring 48. The piston continues to move into cylinder 14 until its rearward motion is stopped by spacer ring 52 as shown in FIG. 3.

During the rearward motion of piston 36, cleaning needles 32 are withdrawn past capillary tube ports 46 but still remain guided in the remainder of capillary tube 24. This action allows the liquid to flow from the central body 16 through discharge pipes 20 and into capillary tubes 24 through capillary tube port 46. The liquid flows through the capillary tubes as laminar streams and exits to form uniform size droplets.

When it is desired to discontinue spraying, liquid supply through inlet 18 is discontinued thereby relieving the liquid pressure in central body 16. Piston 36 is then forced to the neutral position shown in FIG. 2 due to the energy stored in spiral spring 48 and cleaning needles 32 are guided back through capillary tubes 24. The resulting benefits of this action are positive blocking of flow through the tube ports and purging of residues from the capillary tubes. In essence the residue removal is the self cleaning trait of the nozzle.

Another feature of the instant invention is manual override shaft 50. Manual override shaft 50 extends from and through cylinder 14 and is attached at one end to the rear inner wall of elongated portion 38 of piston 36. Shaft 50 provides an external means to dislodge piston 36 if movement becomes restricted and in addition provides a visual representation of the piston stroke. Thus, by pushing and/or pulling the rearward end of shaft 50, which passes through and extends beyond cylinder 14, there is imparted similar motion to piston 36 resulting in manual operation of the cleaning and capillary block means.

The self-cleaning nozzle of the present invention can be made from any rigid material, such as metal or natural or synthetic resin. The one requirement is that the material be resistant to chemicals in the liquid being sprayed.

Alternative embodiments and modes of practicing the invention, but within its spirit and scope, will, in the light of this disclosure, occur to persons skilled in the art. It is intended, therefore, that this description be taken as illustrative only and not be construed in any limiting sense.

I claim:

1. A self-cleaning nozzle for use in spray devices comprising a hollow body, liquid supply means for supplying liquid under pressure to said hollow body; liquid discharge means associated with said hollow body for discharging pressurized liquid from said hollow body, said liquid discharge means including capillary tubes for discharging pressurized liquid from said hollow body and including a plurality of discharge pipes projecting outwardly from said hollow body, each discharge pipe accomodating a plurality of said capillary tubes and each of said capillary tubes having a capillary tube port in liquid communication with said liquid in said hollow body, said capillary tubes being secured to and extending through a capillary tube body detachably secured to said discharge pipes and capillary blocking and cleaning means disposed and positioned in said hollow body including urging means, a piston having an elongated portion, said piston being movable in said hollow body, and cleaning needles associated with said piston, said cleaning needles being positioned in axial alignment with a corresponding capillary tube, each of said cleaning needles being adapted to traverse a path through a corresponding capillary tube, and adapted to be in a first position during non-operation of said self-cleaning nozzle in which said cleaning needles block the passage of liquid through said capillary tubes and which are adapted to be urged toward a second position in which said cleaning needles are partially withdrawn from said capillary tubes whereby said pressurized liquid in said hollow body is permitted to flow through said capillary tubes and thence to be urged back through said tubes to clean said tubes prior to arriving at said first position.

2. A self-cleaning nozzle according to claim 1 wherein said cleaning needles are attached to needle shafts, said needle shafts being associated with said piston whereby movement of said piston imparts motion to said needle shafts.

3. A self-cleaning nozzle according to claim 2 further including an override shaft extending from and into said hollow body and which is secured to said piston.

4. A self-cleaning nozzle according to claim 3 wherein said urging means is a spiral spring positioned around said override shaft and portion of which extends into said elongated portion of said piston.

* * * * *